US007402002B2

(12) United States Patent
Zidar et al.

(10) Patent No.: US 7,402,002 B2
(45) Date of Patent: Jul. 22, 2008

(54) LIFTING ASSEMBLY

(75) Inventors: Robert Zidar, Brookfield, WI (US); Gary Thornton, Edmond, OK (US)

(73) Assignee: T-Z Group, LLC, New Berlin, WI (US)

( * ) Notice: Subject to any disclaimer, the term of this patent is extended or adjusted under 35 U.S.C. 154(b) by 48 days.

(21) Appl. No.: 11/540,948

(22) Filed: Sep. 29, 2006

(65) Prior Publication Data

US 2007/0092340 A1 Apr. 26, 2007

Related U.S. Application Data

(63) Continuation-in-part of application No. 10/749,168, filed on Dec. 30, 2003, now abandoned.

(51) Int. Cl.
*E02D 27/48* (2006.01)

(52) U.S. Cl. ..... 405/230

(58) Field of Classification Search ..... 405/230; 187/203, 204

See application file for complete search history.

(56) References Cited

U.S. PATENT DOCUMENTS

| | | | | |
|---|---|---|---|---|
| 4,765,777 | A | 8/1988 | Gregory | 405/230 |
| 6,142,710 | A | 11/2000 | Holland, Jr. et al. | 405/230 |
| 6,447,209 | B1 | 9/2002 | Ruiz et al. | 405/232 |
| 6,840,714 | B1 * | 1/2005 | Vache | 405/230 |

* cited by examiner

*Primary Examiner*—Sunil Singh
(74) *Attorney, Agent, or Firm*—Donald J. Ersler

(57) ABSTRACT

A lifting assembly for raising and supporting a load includes a removable and reusable lifting bracket. The lifting bracket is designed to fit around and support a support bracket that supports a load. The support bracket is installed on the pole of the pier and engages the edge of the load. The lifting bracket is removably attached to a jacking apparatus for pushing or pulling the piering pole through the support bracket and raising the load on the support bracket. After the lifting operation, the lifting bracket is removed from the jacking apparatus and the support bracket attached to the piering pole for use on adjacent piers and on other lifting assemblies.

19 Claims, 16 Drawing Sheets

LIFTING ASSEMBLY

CROSS-REFERENCE TO RELATED APPLICATION

This application is a continuation-in-part application of U.S. application Ser. No. 10/749,168, filed on Dec. 30, 2003, now abandoned which is specifically incorporated herein by reference in its entirety for all purposes. This application claims the benefit of U.S. application Ser. No. 10/749,168 under 35 U.S.C. § 120.

BACKGROUND OF THE INVENTION

The present invention relates generally to piering systems for raising and supporting building foundations and the like, and more particularly to a lifting assembly comprising a removable and reusable lifting bracket and a support bracket for raising and supporting a load.

Many types of building structures are supported by foundations that in turn are supported by soil rather than by more stable bedrock or other supporting strata. Shifting of the supporting soil over time can cause the foundation to sink, which can lead to various problems including structural damage. Unless the foundation is supported, further shifting can occur and worsen the structural damage. Furthermore, it is frequently desirable to raise the foundation to its original level in order to facilitate restoration of the structure to a proper condition.

In foundation piering systems, the foundation of a structure is excavated down to the footings at each pier location, pilings are driven into the ground through unstable soils to rock or load bearing strata by hydraulic rams for lifting and stabilizing the foundation and preventing future settlement. A support bracket is attached to the foundation footings from below and raised by hydraulic rams for vertical adjustment of the foundation.

Many devices and methods have been developed for raising and supporting a foundation. Many such devices and methods employ piers that are driven into the ground adjacent an edge of the foundation until the piers encounter bedrock or other relatively firm supporting strata. Jacking devices are used for jacking up the edge of the foundation, using the piers for support. When the foundation is raised to the desired level, the foundation is affixed to the piers and the jacking equipment is removed.

In some such lifting devices, brackets are affixed to the foundation and are slidably engaged with the piers, and the jacking devices engage the brackets for raising the foundation. A bracket typically includes a pier-receiving portion such as a collar or sleeve that surrounds the pier in close-fitting fashion, and a support plate rigidly affixed to the pier-receiving portion and configured to engage a lower surface of a foundation. The pier-receiving portion is sized to fit closely about the pier so that the bracket is able to slide upward and downward along the pier but is substantially prevented from moving in any other direction.

U.S. Pat. No. 6,142,710 to Holland Jr. discloses a lifting assembly for raising and supporting an edge of a foundation that includes a lifting saddle slidably received over a pier that is driven into the ground adjacent the edge of the foundation, a bracket supported by the lifting saddle and adapted to be affixed to and to support the foundation, and a jacking apparatus configured to be supported atop an upper end of the pier. The lifting saddle is connected to the jacking apparatus by threaded rods slidably received through the jacking apparatus. The bracket is pivotally connected to the lifting saddle such that the bracket can rock side-to-side, thus self-aligning and remaining aligned with the foundation during a lifting operation. The bracket can also pivot about a vertical axis and can slide in a forward or rearward direction relative to the lifting saddle. The lifting saddle can pivot relative to the pier about a horizontal axis.

The prior art discloses lifting assemblies including a support bracket and a lifting bracket that are attached to a jacking apparatus for lifting a supporting a foundation. The support bracket and lifting bracket are fixed components of a piering system that are not removable or reusable. The present invention provides a lifting bracket that is removable from the support bracket, piering pole and jacking apparatus and can be reused on other lifting assemblies.

SUMMARY OF THE INVENTION

The present invention provides a lifting assembly for raising and supporting a load. The lifting assembly preferably includes a one-piece, integral, removable and reusable lifting bracket (or boot) and a support bracket (or lift tool attachment) used for raising and supporting a load. The lifting bracket is preferably removably attached to a jacking apparatus for pushing or pulling a piering pole through the support bracket and into the ground. One end of the jacking apparatus is attached to the lifting bracket and the other end of the jacking apparatus is attached to an upper end of the pier.

The jacking apparatus preferably includes a support brace located above the lifting bracket. The support brace includes a circular sleeve that encircles the pier driving pole, two support wings extending in opposite directions from the circular sleeve, and a pair of hydraulic rams oriented on either side of and running parallel to the pier driving pole, wherein hydraulic rams connect to respective wings of the lifting bracket and the support wings of the support brace.

The jacking apparatus preferably engages a tubular upper end portion of the pier or a tubular extension added onto the upper end of the pier. The jacking apparatus includes a vertical portion adapted to be slidably received within the pier or pier extension and a support portion adapted to rest atop an upper end of the pier or pier extension. Alternatively, the jacking apparatus can be formed of a short tubular section that receives the upper end of the pier and the lifting bracket can slidably engage the pier below the short tubular section.

The pier driving pole preferably extends through the support bracket and lifting bracket of the lifting assembly. The lifting bracket is preferably removably attached to the pier and the support bracket. If the hydraulic rams are removed from the lifting bracket, the lifting bracket may be removed from the pier and support bracket and reused on another lifting assembly. The support bracket remains attached to the load and the pier.

The lifting bracket of the lifting assembly is constructed to be easily removable from the support bracket and the pier. The removable lifting bracket is designed to fit around the support bracket. The lifting bracket preferably includes a pair of spaced-apart L-shaped lifting members, a pair of semi-circular convex members attached to the rear of the spaced-apart L-shaped lifting members, a pair of horizontal bracing members attached to the rear of the spaced-apart L-shaped lifting members and between the semi-circular convex members, and a pair of vertical bracing members extending between the pair of horizontal bracing members. An opening is formed between the spaced-apart L-shaped lifting members, the convex members and the horizontal bracing members is designed to fit around a tubular member of the support bracket. This opening is sized slightly larger than the tubular member such that the lifting bracket can be removed from the support bracket. The removable lifting bracket can thus be used over and over again on adjacent piers and on other lifting assemblies.

The support bracket of the lifting assembly is constructed to be installed on the pole of a piering system and engage the edge of a load thereon. The support bracket generally includes a tubular member for receiving the pole of a piering system therein, an L-shaped member attached to the tubular member for supporting a load thereon, and a substantially horizontal top member attached on top of the tubular member and having an opening extending therethrough for receiving the top of the tubular member therein.

The present invention can be utilized on single or double piering systems having various push/pull configurations. The present invention also contemplates methods of employing same for the purpose of raising and supporting a load, wherein the lifting bracket is removable from the support bracket and the pier, such that the lifting bracket may be reused on adjacent piers and on other lifting assemblies of a piering system. Unlike prior art configurations, the configuration of the present invention can push a piering pole without having the support bracket supported by the lifting bracket (boot) and can secure the load in position without having the lifting bracket supporting the support bracket.

Various other features, objects, and advantages of the invention will be made apparent to those skilled in the art from the following drawings and detailed description of the invention.

DETAILED DESCRIPTION OF THE INVENTION

Figure 1A:
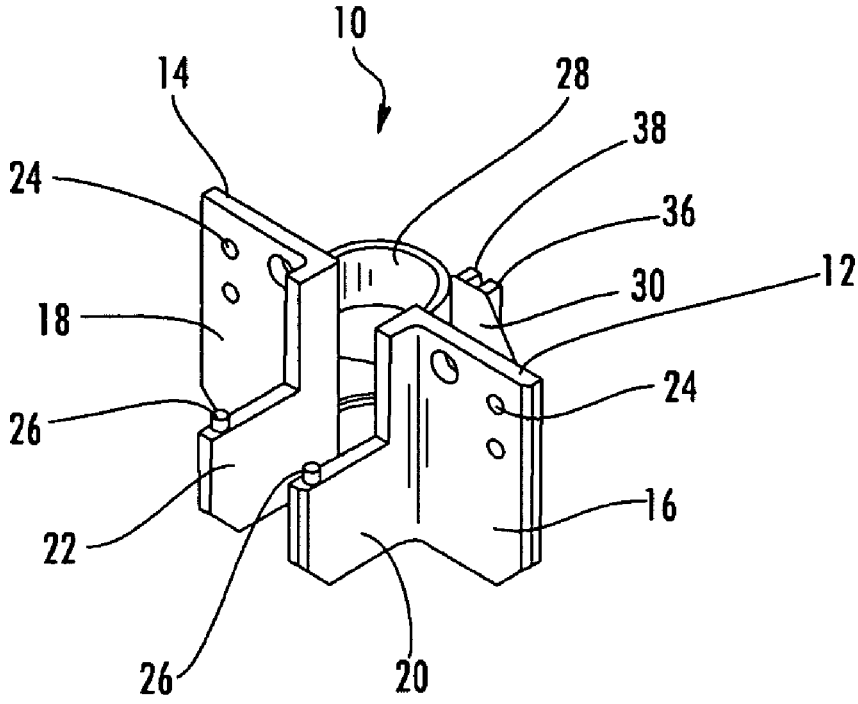
FIG. 1A is a front perspective view of a lifting bracket of the lifting assembly of the present invention.
Figure 1B:
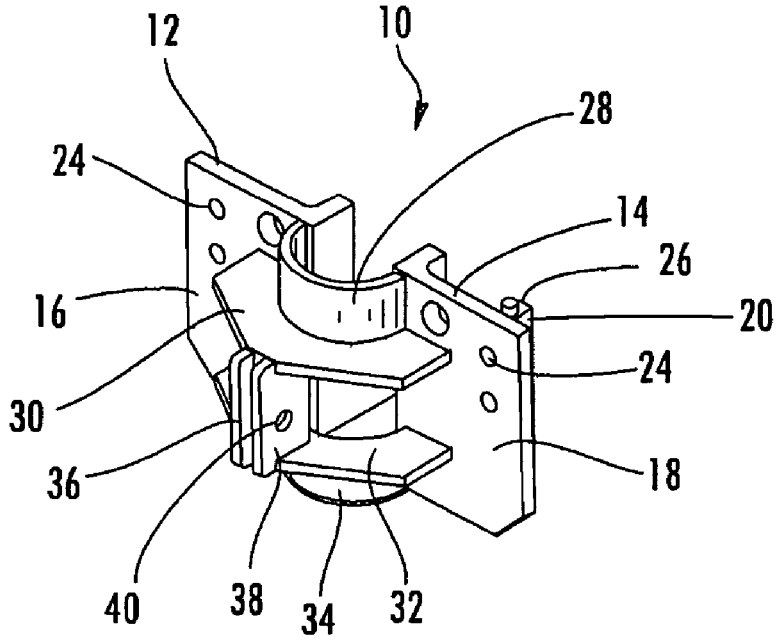
FIG. 1B is a rear perspective view of the lifting bracket of FIG. 1A.

Referring now to the drawings, FIGS. 1A and 1B illustrate a preferred embodiment of a lifting bracket 10 in accordance with the present invention. The one-piece, integral, reusable and removable lifting bracket 10 preferably includes a pair of spaced-apart L-shaped lifting members 12, 14, the lifting members 12, 14 having a pair of lifting wings 16, 18 formed on opposite sides thereof and a pair of support arms 20, 22 extending perpendicularly from the lifting wings. The lifting wings 16, 18 having a plurality of holes 24 extending therethrough for attachment to one end of a jacking apparatus and the lifting arms 20, 22 having a portion cut-out therefrom and a projection 26 extending upwardly from the top surface of each lifting arm at the ends thereof for receiving an L-shaped support bracket thereon.

The lifting bracket 10 further includes an upper semi-circular convex member 28 attached to the rear of the lifting wings 16, 18 and connected between the spaced-apart opening between the lifting members 12, 14, a first horizontal bracing member 30 attached to the rear of the lifting wings 16, 18 below the upper convex member 28 and connected between the spaced-apart opening between the lifting members 12, 14, a second horizontal bracing member 32, spaced-apart from the first horizontal bracing member 30, attached to the rear of the lifting wings 16, 18 above a lower convex member 34 and connected between the spaced-apart opening between the lifting members 12, 14, a lower semi-circular convex member 34 attached to the rear of the lifting wings 16, 18 and connected between the spaced-apart opening between the lifting members 12, 14, and a pair of spaced-apart parallel vertical bracing members 36, 38 connected between the first and second horizontal bracing members 30, 32. The vertical bracing members 30, 32 each having an opening 40 extending therethrough.

The lifting members 12, 14, convex members 28, 34, and bracing members 30, 32, 36, 38, collectively define a tubular-receiving opening through which a tubular member can be received therein. The tubular-receiving opening formed between the spaced-apart L-shaped lifting members 12, 14, the convex members 28, 34, and the horizontal bracing members 30, 32 is designed to fit around a tubular member of the support bracket. This opening is preferably large enough to accommodate the diameter of the tubular member of the support bracket therein and sized slightly larger than the tubular member such that the lifting bracket can be removed from the support bracket.

Figure 2A:
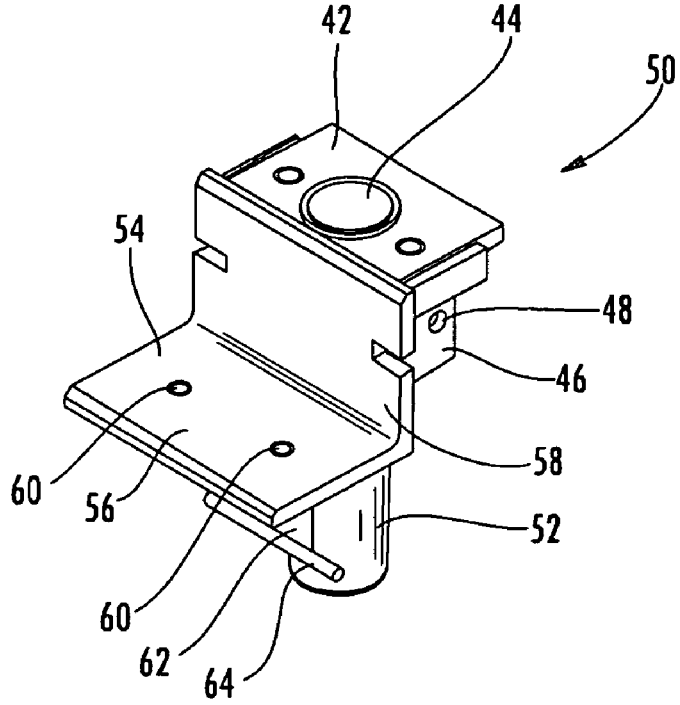
FIG. 2A is a front perspective view of a support bracket of the lifting assembly of the present invention.
Figure 2B:
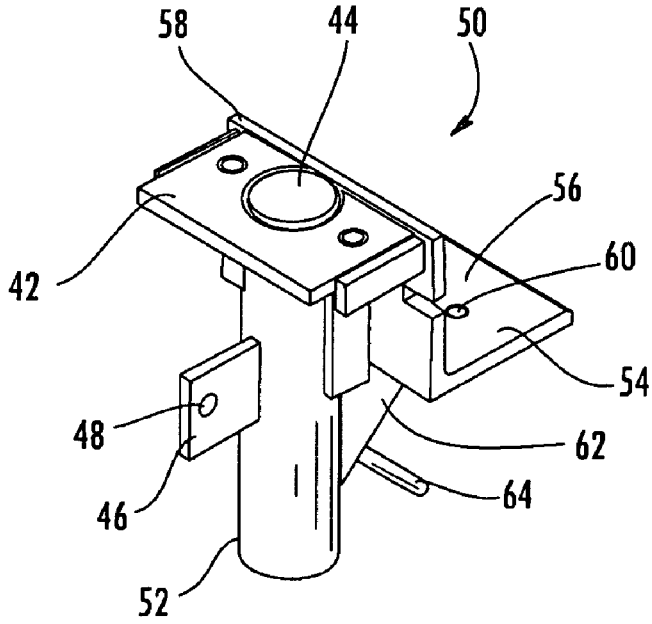
FIG. 2B is a rear perspective view of the support bracket of FIG. 2A.

FIGS. 2A and 2B illustrate a preferred embodiment of a support bracket 50 in accordance with the present invention. The support bracket 50 is preferably constructed to be installed on the pole of a piering system and engage the edge of a load thereon. The support bracket 50 includes a tubular member 52 for receiving the pole of a piering system therein, an L-shaped support member 54 attached to the tubular member 52 for supporting a load thereon. The support member 54 having a generally horizontal portion 56 adapted to engage a lower surface of the edge of a load, the generally horizontal portion 56 having a pair of openings 60 extending therethrough for receiving the projections 26 of the support arms 20, 22 of the lifting members 12, 14 therein when the lifting bracket 10 is positioned around the support bracket 50, and a generally vertical portion 58 extending perpendicular from one side of the horizontal portion 56.

The support bracket 50 further includes a top member 42 attached to the top of the tubular member 52 and extending perpendicular from the top of the vertical portion 58 having an opening 44 extending therethrough for receiving the tubular member 52 therein, a vertical alignment member 46 extending outwardly from the tubular member 52 opposite the support member 54 having an opening 48 extending therethrough, an angle bracing member 62 attached between the tubular member 52 and the bottom of the horizontal portion 56, an alignment pin 64 attached to the bottom of the angle bracing member 62 for aligning and supporting the lifting bracket 10 around the support bracket 50, and a plurality of lateral bracing members 64 for bracing the support member 54 and top member 42 to the tubular member 52.

FIGS. 3A, 3B, 3C and 3D illustrate various views of an embodiment of a lifting assembly 70 in accordance with the present invention. The lifting assembly 70 includes a lifting bracket 10 and a support bracket 50 attached to a piering system jacking apparatus 72. One end of the jacking apparatus 72 is attached to the lifting bracket 10 and the other end of the jacking apparatus 72 is attached to an upper end of a piering pole 74 for pulling or pushing the piering pole 74 through the support bracket 50 to raise or lift a load. The embodiment shown in FIGS. 3A, 3B, 3C and 3D is an example of a pulling piering system.

The jacking apparatus 72 preferably includes a support brace 76 located above the lifting bracket 10. The support brace 76 preferably includes a circular sleeve 78 that encircles and slidably receives the piering pole 74 or a tubular extension added onto the upper end of the pole, two support wings 80, 82 extending in opposite directions from the circular sleeve 78, and a pair of hydraulic rams 84, 86 oriented on either side of and running parallel to the piering pole 74 that are fastened to respective lifting wings 16, 18 of the lifting bracket 10 and support wings 80, 82 of the support brace 76.

Figure 3A:
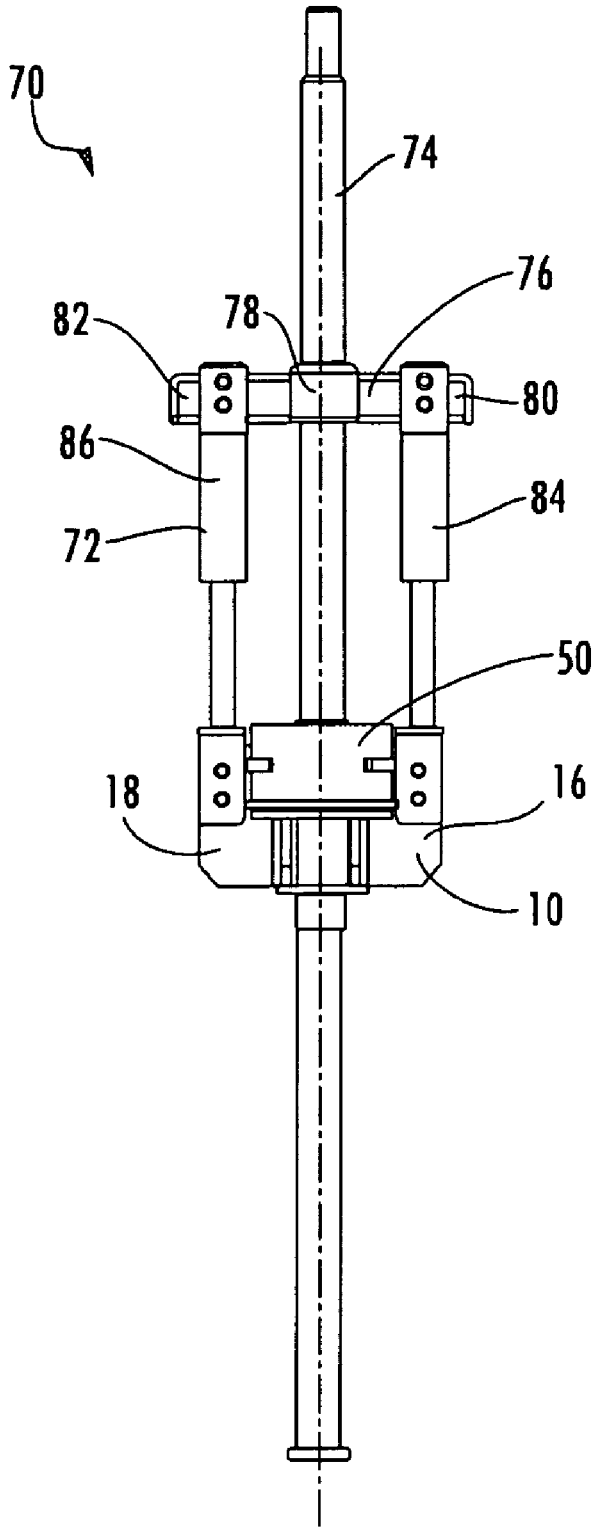
FIG. 3A is a front plan view of the lifting bracket and the support bracket attached to the piering system comprising an embodiment of a lifting assembly of the present invention.
Figure 3B:
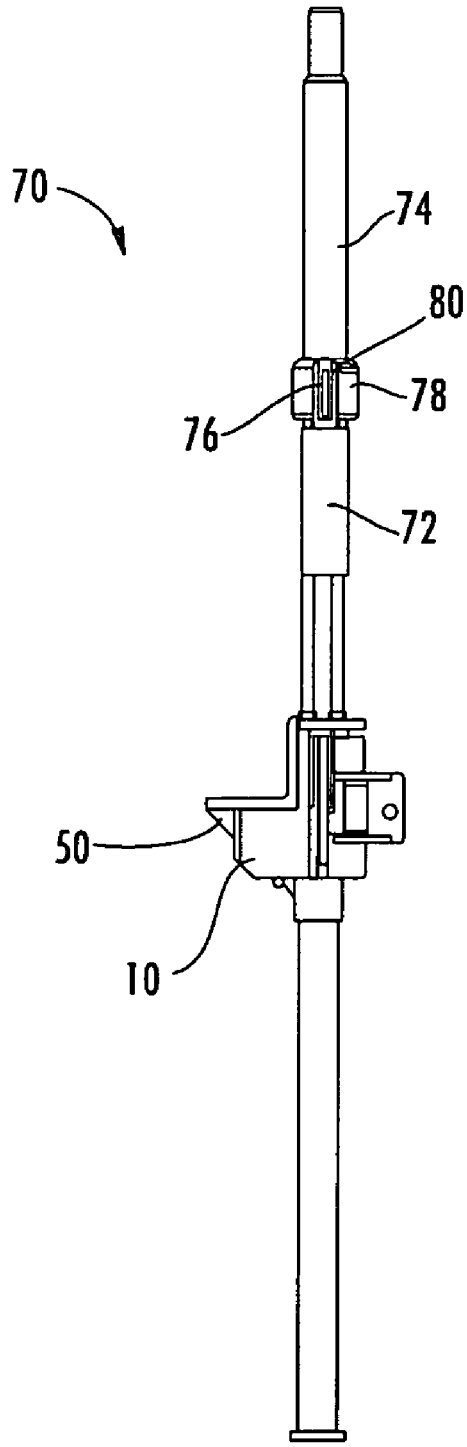
FIG. 3B is a side plan view of the lifting assembly of FIG. 3A.
Figure 3C:
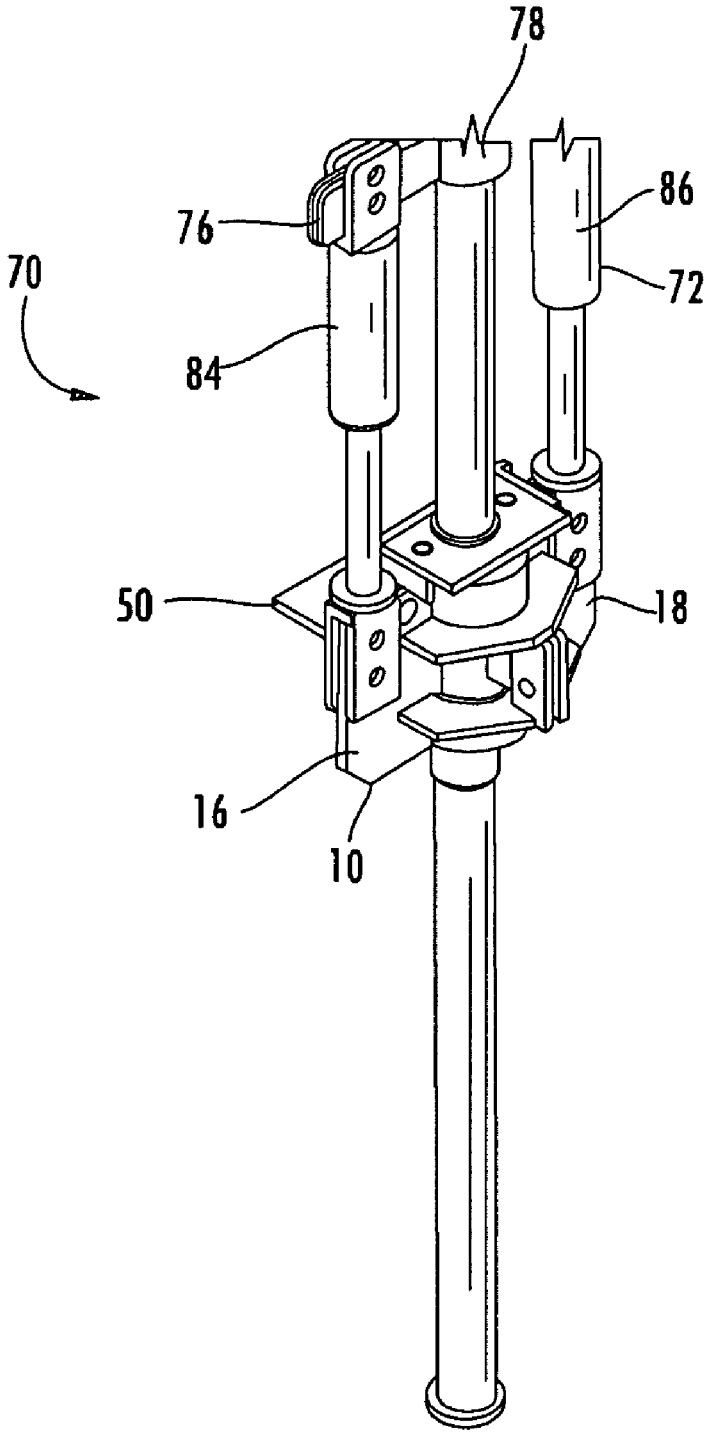
FIG. 3C is a detailed perspective view of the lifting assembly of FIGS. 3A and 3B.
Figure 3D:
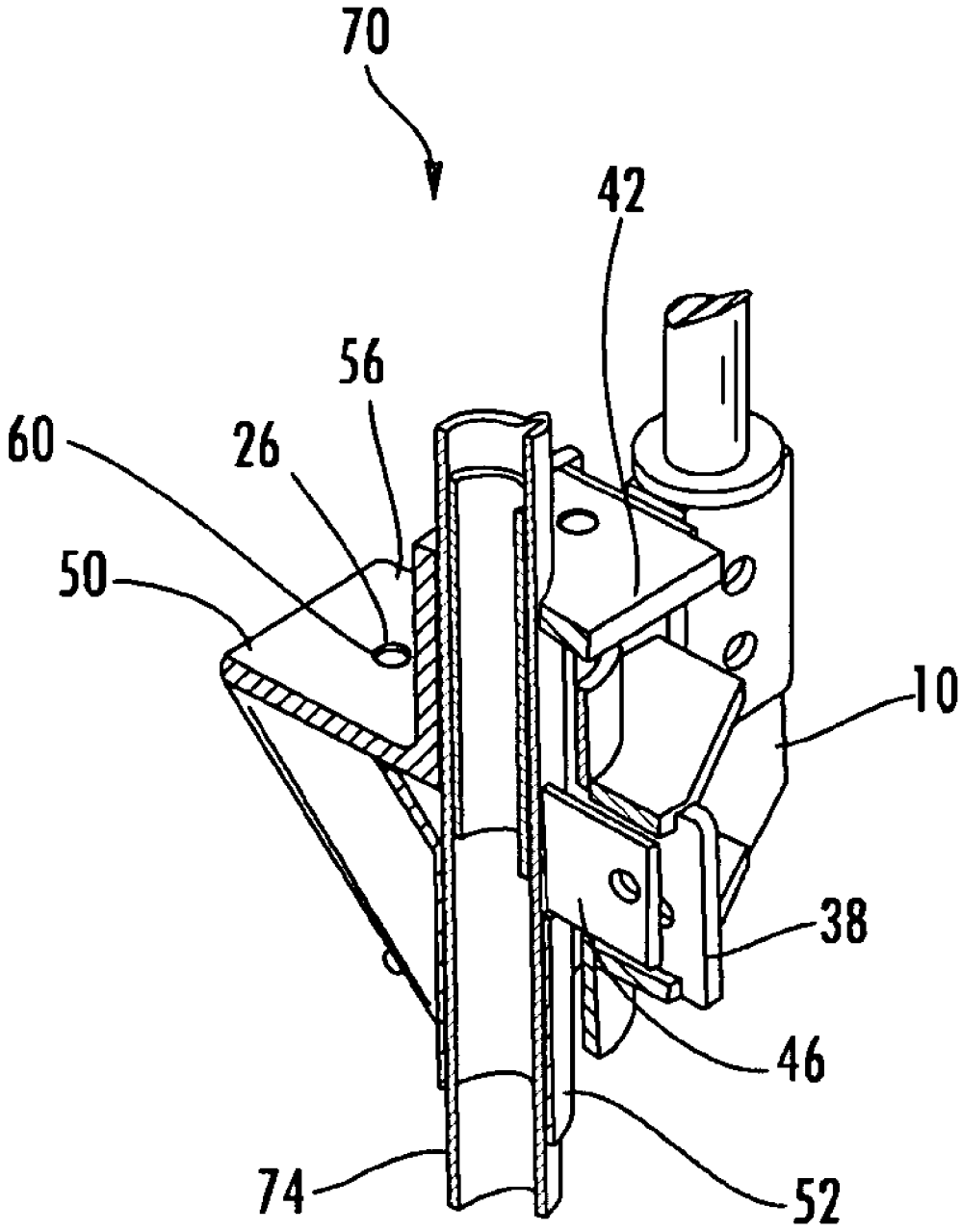
FIG. 3D is a cross-sectional view of the lifting bracket and the support bracket attached to the piering system of the lifting assembly of the present invention.
Figure 4B:
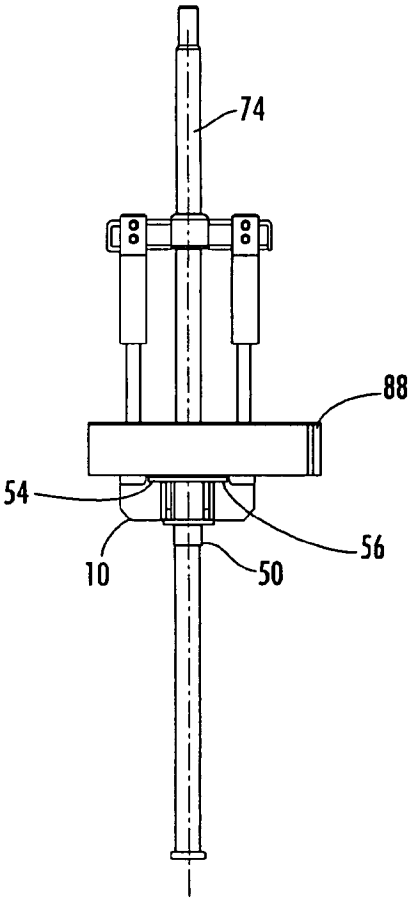
FIG. 4B is a front plan view of the lifting assembly of FIG. 4A.
Figure 4A:
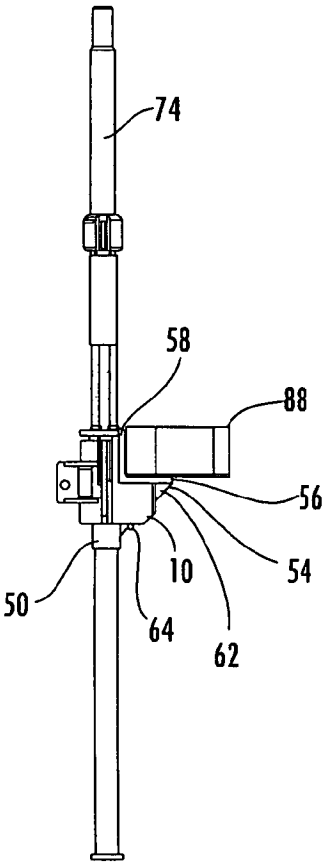
FIG. 4A is a side plan view of the lifting bracket and the support bracket attached to the piering system and supporting a slab comprising another embodiment of a lifting assembly of the present invention.
Figure 4C:
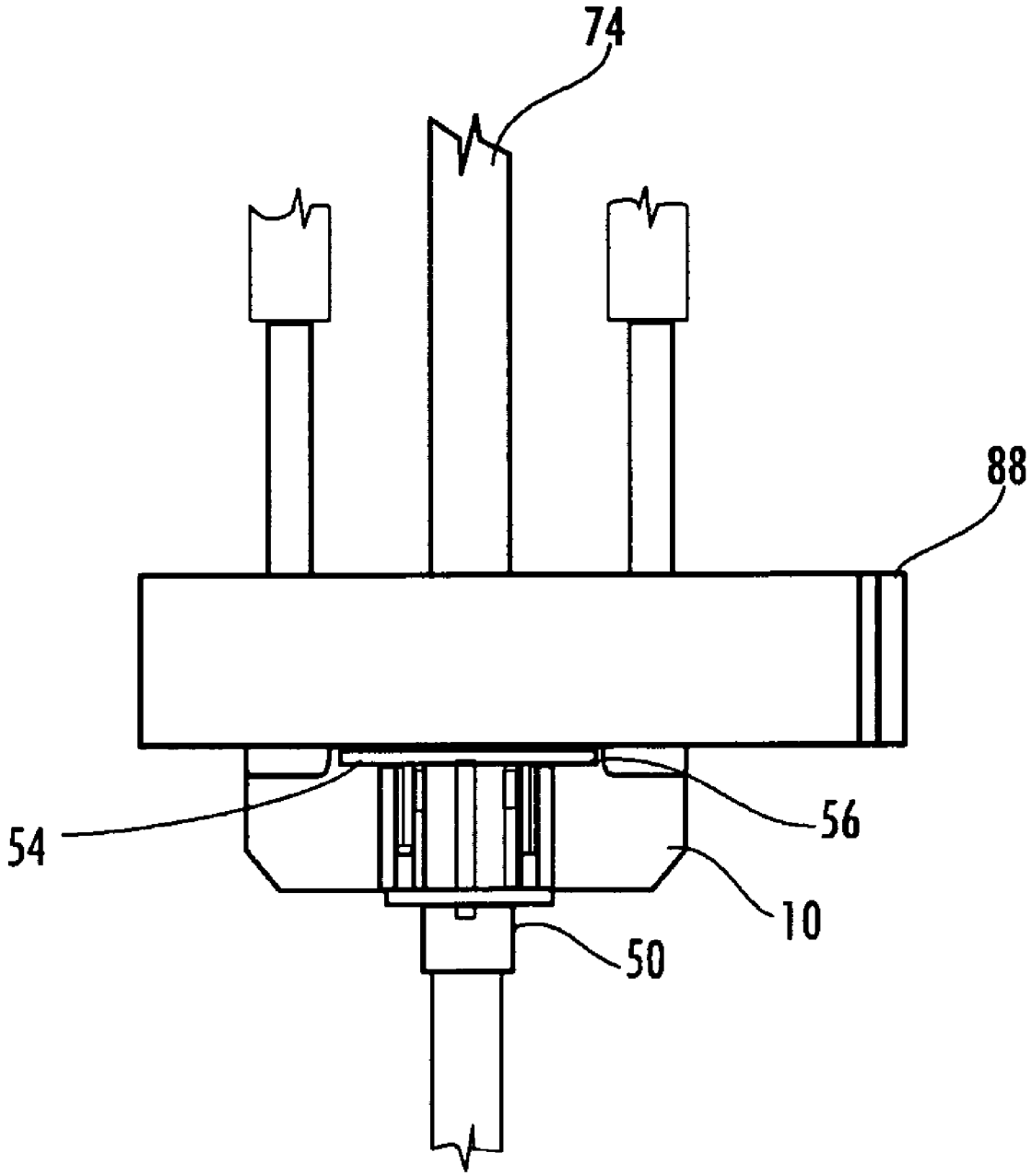
FIG. 4C is a detailed front plan view of the lifting assembly of FIGS. 4A and 4B.
Figure 4D:
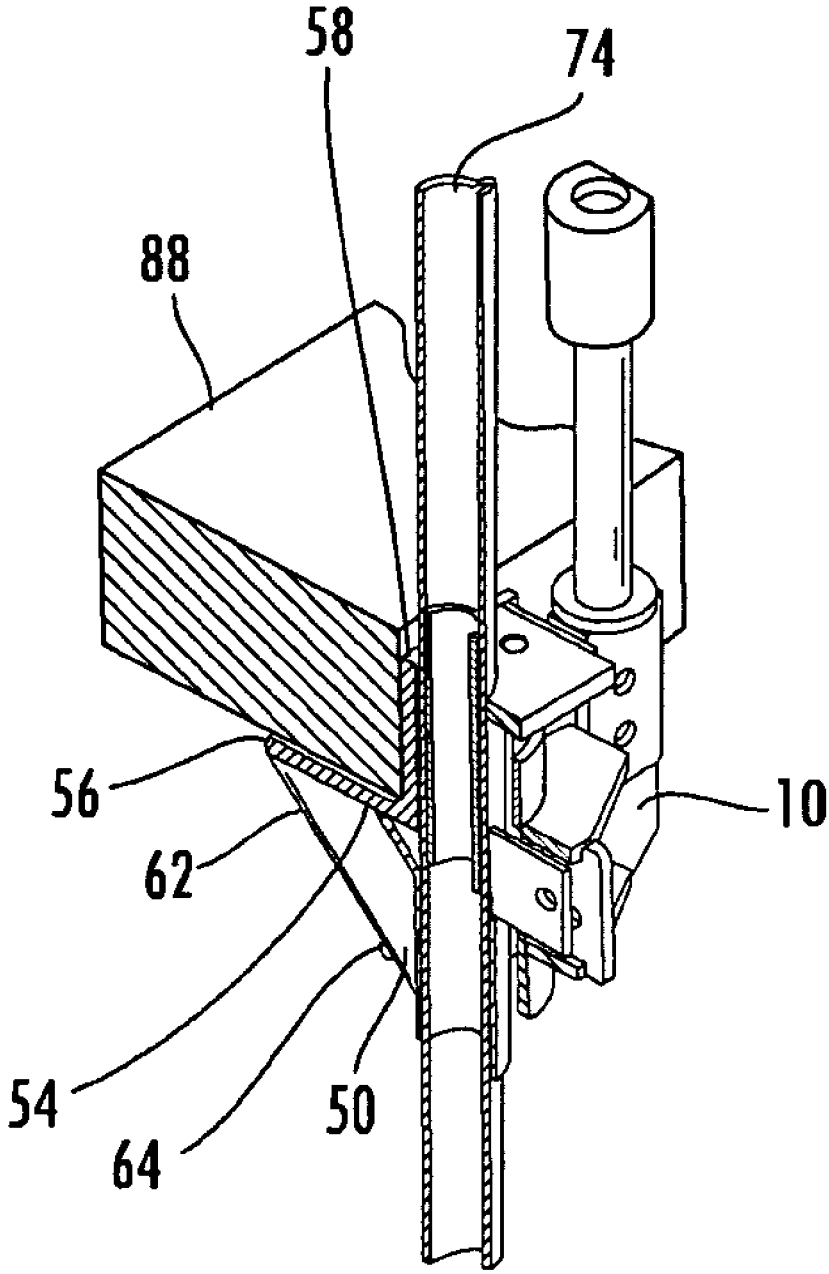
FIG. 4D is a cross-sectional view of the lifting bracket and the support bracket attached to the piering system of the lifting assembly of the present invention.

FIG. 3D illustrates the details of the lifting assembly 70. The piering pole 74 preferably extends through the tubular member 52 of the support bracket 50 of the lifting assembly. The lifting bracket 10 is removably attached around the outside of the support bracket 50. The support bracket 50 is preferably supported on the lifting arms 20, 22 of the lifting bracket 10.

The horizontal portion 56 of the support bracket 50 preferably rests upon the projections 26 and lifting arms 20, 22 of the lifting bracket. The projections 26 extending from the top of the lifting arms 20, 22 are preferably inserted into the openings 60 in the horizontal portion 56 of the support member 54 of the support bracket. The top member 42 of the support bracket 50 extends over the top of the lifting bracket 10. The vertical alignment member 46 of the support bracket 50 extends between the pair of spaced-apart parallel vertical bracing members 36, 38 of the lifting bracket.

FIGS. 4A, 4B, 4C and 4D illustrate various views of the lifting bracket and the support bracket attached to the piering system shown in FIGS. 3A, 3B, 3C and 3D, but supporting a load. The only difference between FIGS. 3A, 3B, 3C and 3D and FIGS. 4A, 4B, 4C and 4D is that a load 88 is shown being supported by the horizontal 56 and vertical 58 portions of the L-shaped support member 54 of the support bracket.

The support bracket 50 is preferably constructed to be installed on the pole 74 of a piering system and engage the edge of a load 88 thereon. The L-shaped support member 54 includes a generally horizontal portion 56 adapted to engage a lower surface of the edge of a load 88, and a generally vertical portion 58 extending perpendicular from one side of the horizontal portion 56 adapted to engage a vertical surface of the edge of the load 88. The alignment pin 64 attached to the bottom of the angle bracing member 62 of the support bracket 50 aligns and supports the lifting bracket 10 around the support bracket. The lifting bracket 10 is configured to support the support bracket 50 such that upward movement of the lifting bracket 10 causes the support bracket 50 to lift the load 88.

Figure 5C:
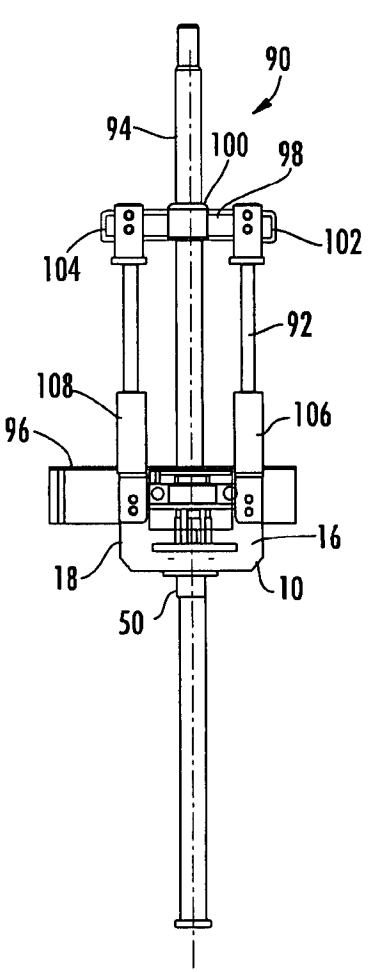
FIG. 5C is a rear plan view of the lifting assembly of FIGS. 5A and 5B.
Figure 5B:
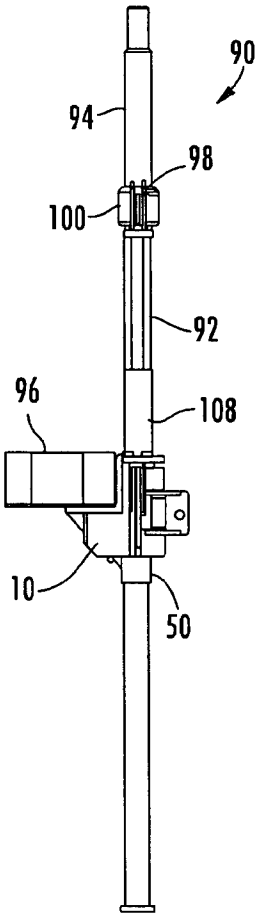
FIG. 5B is a side plan view of the lifting assembly of FIG. 5A.
Figure 5A:
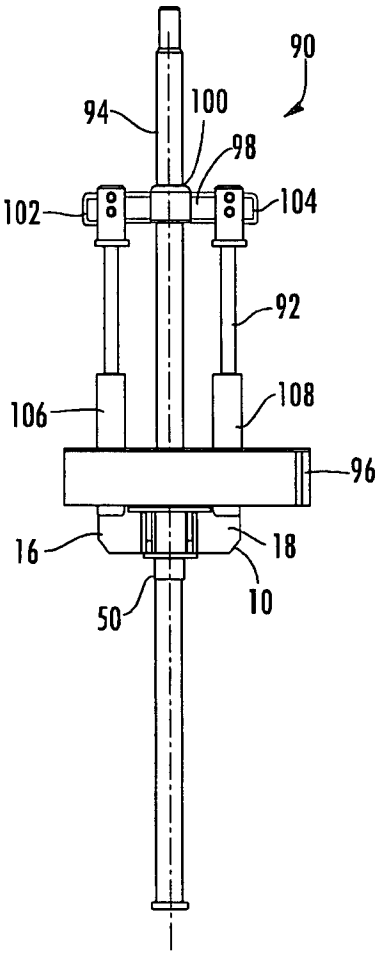
FIG. 5A is a front plan view of the lifting bracket and the support bracket attached to the piering system and supporting a slab comprising yet another embodiment of a lifting assembly of the present invention.

FIGS. 5A, 5B and 5C illustrate various views of the lifting bracket and the support bracket attached to a piering system comprising another embodiment of a lifting assembly supporting a load in accordance with the present invention. The embodiment shown in FIGS. 5A, 5B and 5C is another embodiment of a pulling piering system in accordance with the present invention. The difference between the pulling piering system shown in FIGS. 4A, 4B, 4C and 4D and the pulling piering system shown in FIGS. 5A, 5B and 5C is the jacking apparatus.

The lifting assembly 90 includes a lifting bracket 10 and a support bracket 50 attached to a piering system jacking apparatus 92. One end of the jacking apparatus 92 is attached to the lifting bracket 10 and the other end of the jacking apparatus 92 is attached to an upper end of a piering pole 94 for pulling or pushing the piering pole 94 through the support bracket 50 to raise or lift a load 96.

The jacking apparatus 92 preferably includes a support brace 98 located above the lifting bracket 10. The support brace 98 preferably includes a circular sleeve 100 that encircles and slidably receives the piering pole 94 or a tubular extension added onto the upper end of the pole, two support wings 102, 104 extending in opposite directions from the circular sleeve 100, and a pair of hydraulic rams 106, 108 oriented on either side of and running parallel to the piering pole 94 that are fastened to respective lifting wings 16, 18 of the lifting bracket 10 and support wings 102, 104 of the support brace 98. The difference in the jacking apparatus 92 of FIGS. 5A, 5B and 5C is that the hydraulic rams 106, 108 are inverted from the hydraulic rams 84, 86 of the jacking apparatus 72 shown in FIGS. 3A, 3B, 3C, 3D, 4A, 4B, 4C and 4D.

Figure 6A:
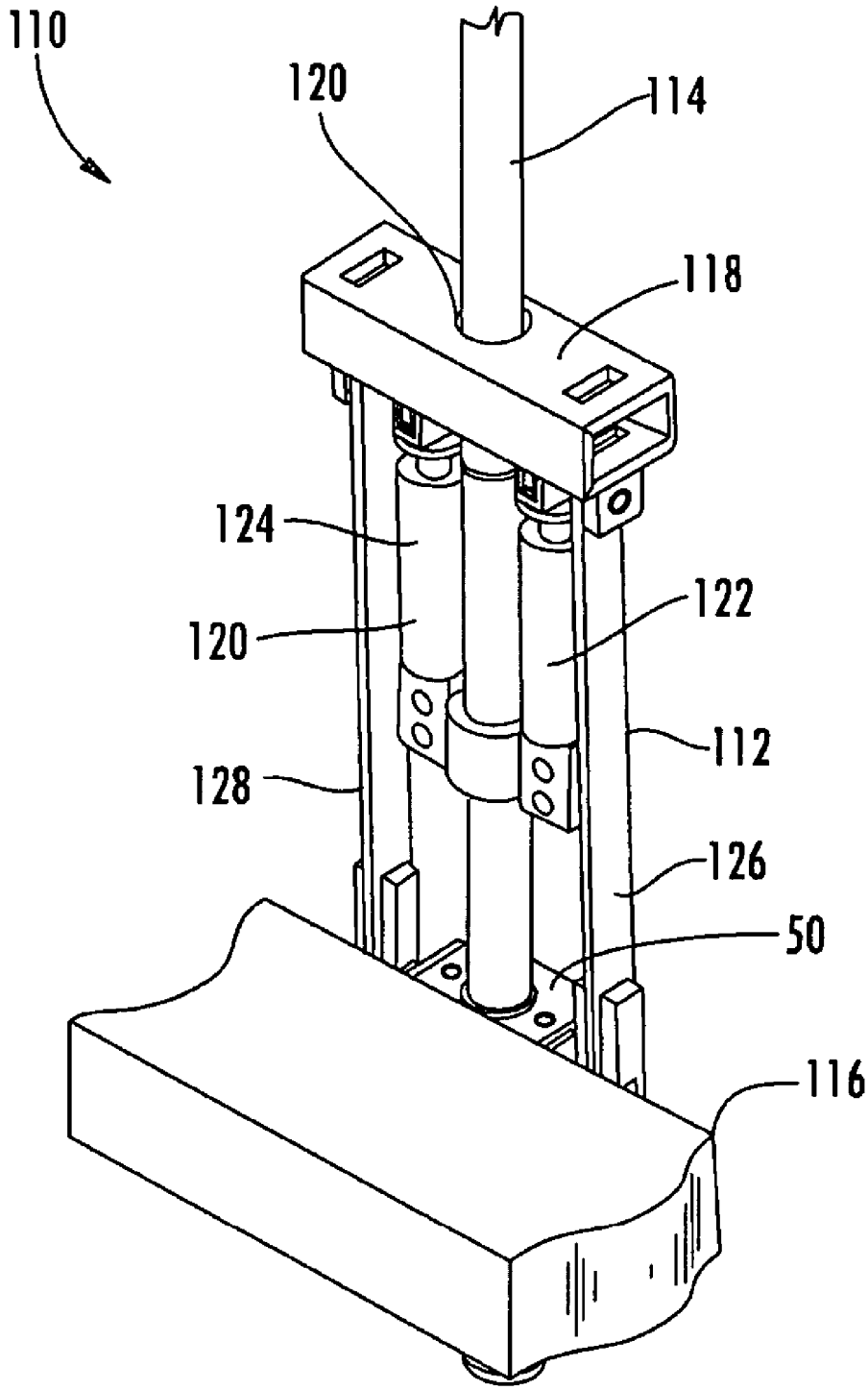
FIG. 6A is a perspective view of the lifting bracket and the support bracket attached to the piering system and supporting a slab comprising still another embodiment of a lifting assembly of the present invention.
Figure 6C:
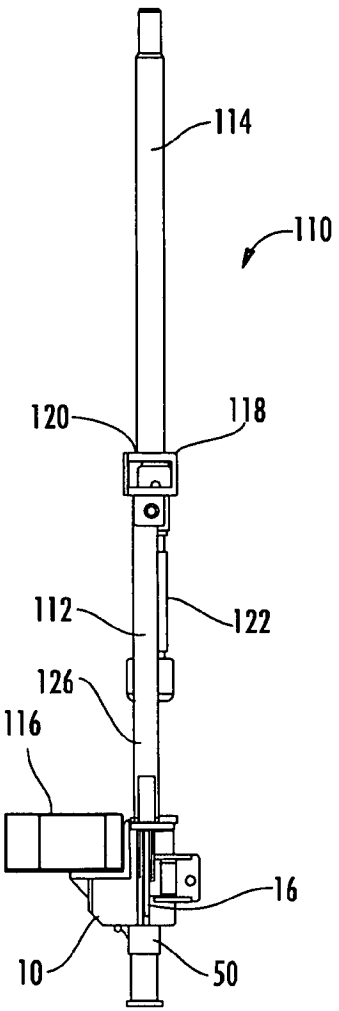
FIG. 6C is a side plan view of the lifting assembly of FIGS. 6A and 6B.
Figure 6B:
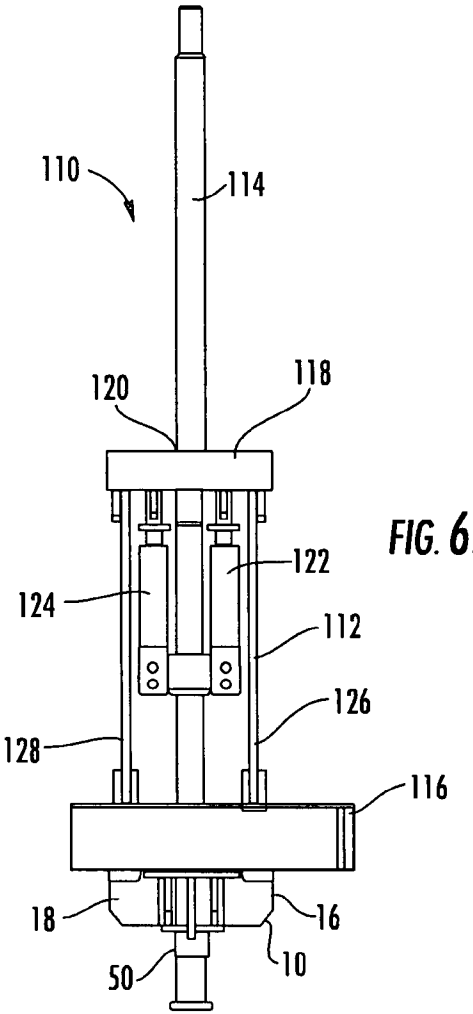
FIG. 6B is a front plan view of the lifting assembly of FIG. 6A.

FIGS. 6A, 6B and 6C illustrate various views of the lifting bracket and support bracket attached to the piering system comprising yet another embodiment of a lifting assembly supporting a load in accordance with the present invention. FIGS. 6A, 6B and 6C show an embodiment of a pushing piering system that lifts a load by pushing a piering pole into the ground.

The lifting assembly 110 includes a lifting bracket 10 and a support bracket 50 attached to a piering system jacking apparatus 112. One end of the jacking apparatus 112 is attached to the lifting bracket 10 and the other end of the jacking apparatus 112 is attached to an upper end of a piering pole 114 for pushing the piering pole 114 through the support bracket 50 and into the ground to raise or lift the load 116.

The jacking apparatus 112 preferably includes an upper support brace 118 located above the lifting bracket 10. The support brace 118 preferably includes an opening 120 extending therethrough for slidably receiving the piering pole 114 or a tubular extension added onto the upper end of the pole, a hydraulic ram assembly 120 attached to the bottom of the support brace 118 including a pair of hydraulic rams 122, 124 oriented on either side of and connecting to the piering pole 114, and a pair of lateral braces 126, 128 oriented on either side of the hydraulic rams 122, 124 and running parallel to the hydraulic rams 122, 124 that are fastened to respective lifting wings 16, 18 of the lifting bracket 10 and the support brace 118.

Figure 7C:
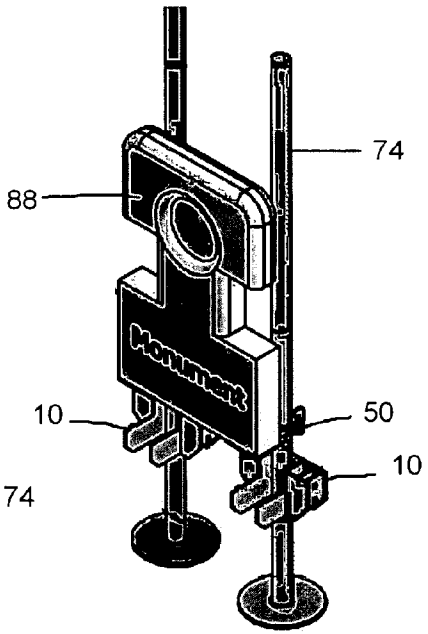
FIG. 7C is a perspective view of the configuration of FIG. 7A.
Figure 7B:
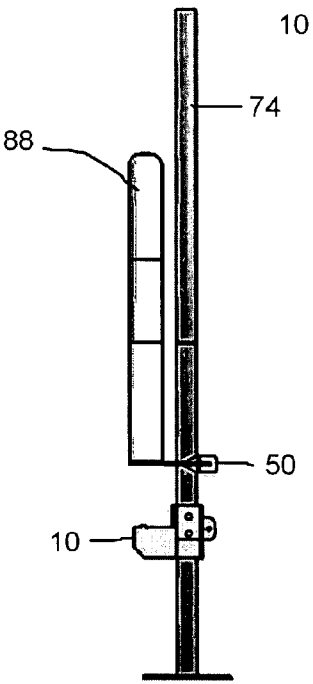
FIG. 7B is a side plan view of the configuration of FIG. 7A.
Figure 7A:
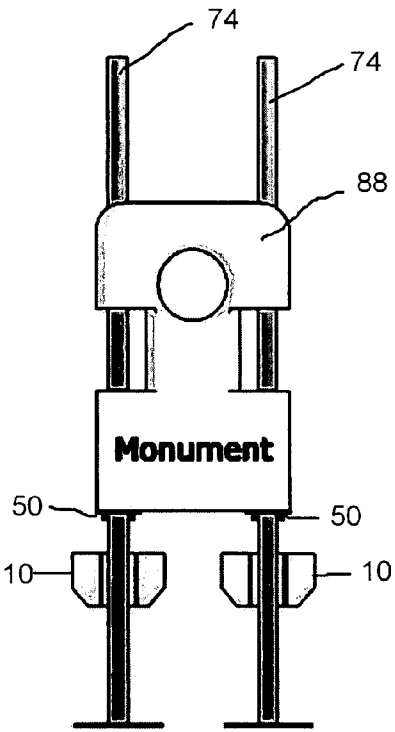
FIG. 7A is a front plan view of a support bracket supporting a load (labeled "Monument") in place without the positioning of a lifting bracket directly underneath it in accordance with another embodiment of the present invention.
Figure 8:
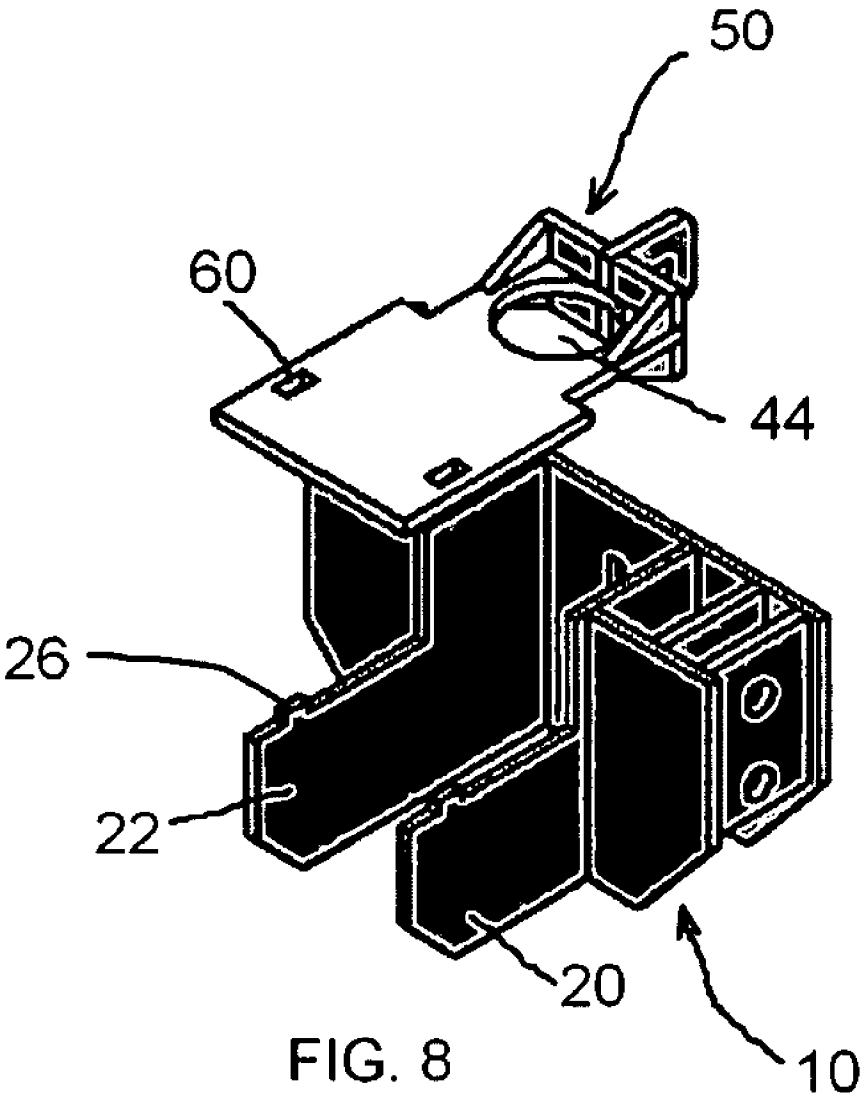
FIG. 8 is a detailed of the alternative embodiments of a support bracket and a lifting bracket as reflected in FIGS. 7A-7C.

FIGS. 7A-7C show a load 88 secured in position on an alternative embodiment of a support bracket 50 without the need for lifting bracket 10 to be positioned thereunder. Support bracket 50 is engaged to the load 88 regardless of whether lifting bracket 10 is positioned thereunder and remains permanently in place along with connected piering pole 74 after load 88 has been lifted and placed into its final position. FIG. 8 is a detailed view of the alternative embodiments of lifting bracket 10 and support bracket 50. Of course, many other embodiments and configurations are also possible without departing from the spirit of the invention.

Figure 11B:
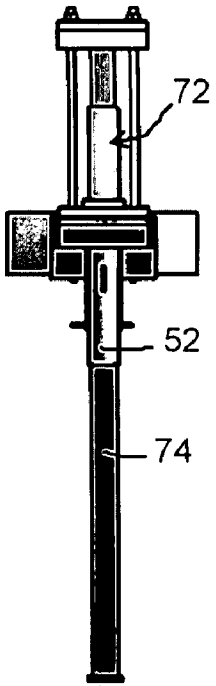
FIGS. 11A and 11B are a side plan view and a rear plan view of the push configuration embodiment shown in FIGS. 9A and 9B with the hydraulic ram fully extended.
Figure 11A:
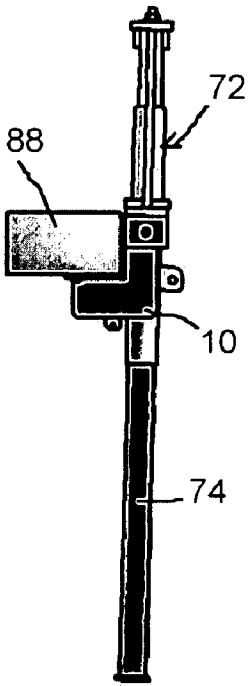
Figure 10B:
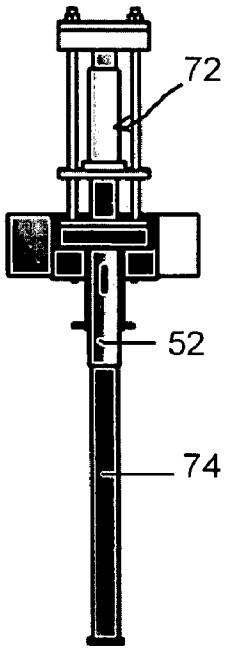
FIGS. 10A and 10B are a side plan view and a rear plan view of the push configuration embodiment shown in FIGS. 9A and 9B with the hydraulic ram partially extended.
Figure 10A:
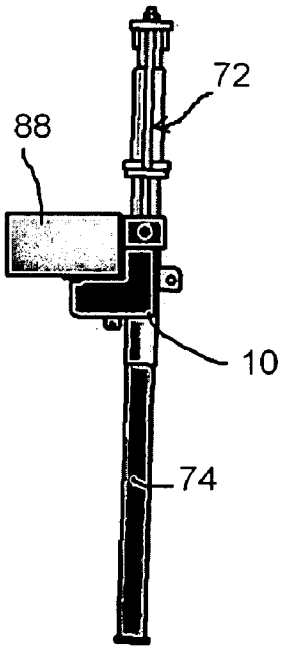
Figure 9B:
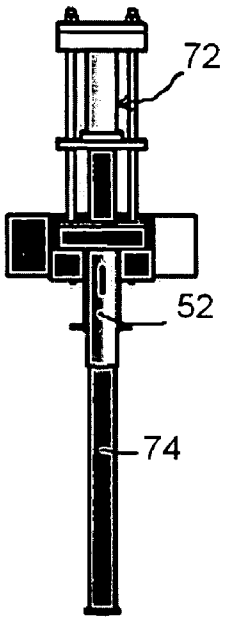
FIGS. 9A and 9B are a side plan view and a rear plan view of a push configuration embodiment of the present invention shown with the hydraulic ram unextended.
Figure 9A:
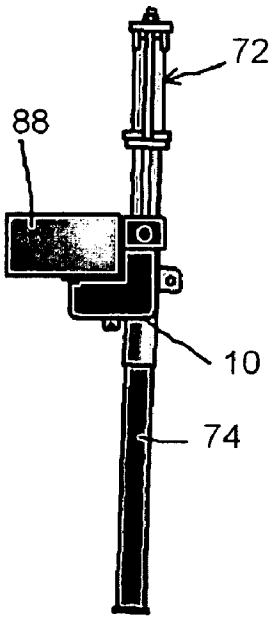

FIGS. 9-11 show operation of one embodiment of a push configuration embodiment of the present invention. In FIGS. 9A and 9B, jacking apparatus 72 is shown with its hydraulic ram unextended. As the hydraulic ram of the jacking apparatus 72 extends (partial extension shown in FIGS. 10A and 10B and full extension shown in FIGS. 11A and 11B), the load 88 is lifted as the piering pole 74 is forced through the support bracket 50 to raise the load 88.

Figures 12A, 12B, 13A, 13B, 14A, 14B:
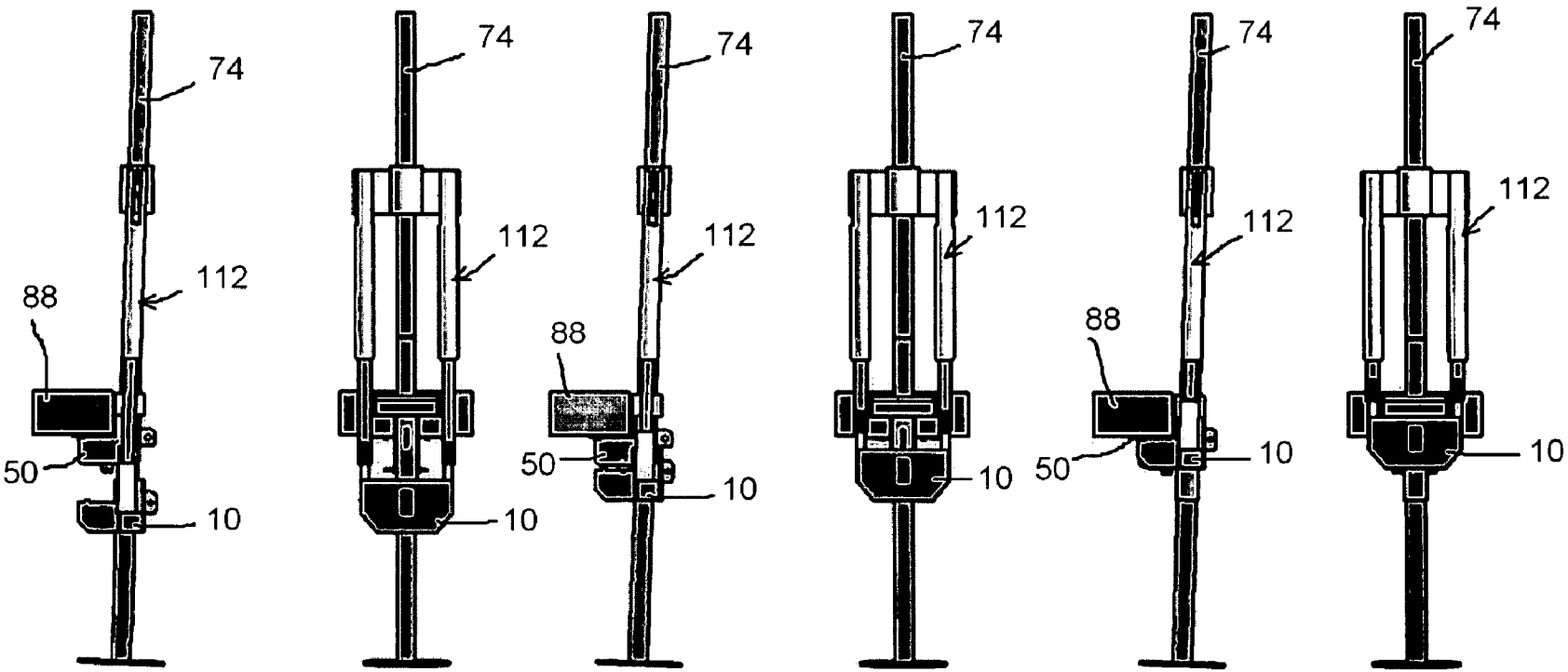
FIGS. 12A and 12B are a side plan view and a rear plan view of a pull configuration embodiment of the present invention shown with the lifting bracket positioned away from the support bracket.
FIGS. 13A and 13B are a side plan view and a rear plan view of the push configuration embodiment shown in FIGS. 12A and 12B with the lifting bracket positioned in a mid position with respect to the support bracket.
FIGS. 14A and 14B are a side plan view and a rear plan view of the push configuration embodiment shown in FIGS. 12A and 12B with the lifting bracket engaging the support bracket.

FIGS. 12-14 show operation of one embodiment of a pull configuration embodiment of the present invention. In FIGS. 12A and 12B, jacking apparatus 112 is fully extended such that support bracket 50 is not positioned on lifting bracket 10. As jacking apparatus 112 retracts, piering pole 74 is caused to be pushed downward through support bracket 50. Thus, as illustrated, this configuration allows the pushing of the piering pole 74 downward without having support bracket 50 engaged to lifting bracket 10. In this embodiment, as jacking apparatus 112 reaches nearly full retraction, lifting bracket 10 becomes engaged under support bracket 50 and may cause support bracket 50 to raise load 88 or continue to force piering pole 74 downward.

Operation of the lifting assembly includes excavating the foundation of a structure down to the footings, installing a piering system along the foundation in order to lift a settled foundation, attaching a lifting assembly and a jacking apparatus to the piering system, attaching a support bracket of the lifting assembly to the foundation footings, driving a piering pole into the ground through unstable soils to rock or load bearing strata for lifting and supporting the foundation on the support bracket, removing the jacking apparatus from the lifting assembly, removing the lifting bracket from the lifting assembly leaving only the support bracket and the piering pole, cutting off the piering pole and anchoring the top of the pole to the support bracket, and using the removed lifting bracket on other lifting assemblies or piering systems.

The lifting assembly of the present invention includes various accessories, such as, a foot for insertion into the bottom of the piering pole, a plug for insertion into the bottom of the piering pole, a coupling for connecting sections of the piering pole together, various lengths of drive pipe for driving the piering pole into the ground, a piering pole guide bushing, and a shim plate.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention.

We claim:

1. A lifting assembly for raising and supporting a load, the lifting assembly comprising:

a removable and reusable lifting bracket, the lifting bracket configured from a plurality of permanently secured together pieces;

a support bracket for permanent attachment to the load, the support bracket having a tubular member depending therefrom, an L-shaped member being attached to the tubular member for supporting the load thereon, a substantially horizontal top member being attached to a top of the tubular member and having an opening extending therethrough for receiving the top of the tubular member, the lifting bracket removably positioned under the support bracket and at least partially surrounding the tubular member; and a jacking apparatus having one end removably attached to the lifting bracket and another end attached to a piering pole above the lifting bracket.

2. The lifting assembly of claim 1 wherein the lifting bracket includes a pair of spaced-apart L-shaped lifting members;

a pair of semi-circular convex members attached to the rear of the spaced-apart L-shaped lifting members;

a pair of horizontal bracing members attached to the rear of the spaced-apart L-shaped lifting members and between the semi-circular convex members;

and a pair of vertical bracing members extending between the pair of horizontal bracing members.

3. The lifting assembly of claim 2 wherein an opening is formed between the spaced-apart L-shaped lifting members, the convex members and the horizontal bracing members and is designed to fit around the tubular member of the support bracket.

4. The lifting assembly of claim 1 wherein:

the piering pole extends through the support bracket and lifting bracket.

5. The lifting assembly of claim 1 wherein:

the support bracket is installed on the piering pole for engaging the edge of the load.

6. The lifting assembly of claim 1 wherein:

the lifting bracket is removably attached to the jacking apparatus for pushing or pulling the piering pole through the support bracket and into the ground.

7. The lifting assembly of claim 1 wherein:

one end of the jacking apparatus is attached to the lifting bracket and the other end of the jacking apparatus is attached to an upper end of the piering pole.

8. The lifting assembly of claim 1 wherein:

the jacking apparatus includes a support brace located above the lifting bracket.

9. The lifting assembly of claim 8 wherein:

the support brace includes a circular sleeve that encircles the piering pole, two support wings extending in opposite directions from the circular sleeve, and a pair of hydraulic rams oriented on the either side of and running parallel to the piering pole.

10. The lifting assembly of claim 9 wherein:

the hydraulic rams connect to respective wings of the lifting bracket and support wings of the support brace.

11. A lifting assembly for raising and supporting a load, the lifting assembly comprising:

a removable and reusable lifting bracket, the lifting bracket configured from a plurality of permanently secured together pieces;

a support bracket for permanent attachment to the load, the support bracket having a tubular member depending therefrom, an L-shaped member being attached to the tubular member for supporting the load thereon, a substantially horizontal top member being attached to a top of the tubular member and having an opening extending therethrough for receiving the top of the tubular member, the lifting bracket removably positioned under the support bracket and at least partially surrounding the tubular member; and a jacking apparatus having one end removably attached to the lifting bracket and another end attached to a piering pole above the lifting bracket, wherein said jacking apparatus for pushing or pulling the piering pole through the support bracket and into the ground.

12. The lifting assembly of claim 11 wherein the lifting bracket includes a pair of spaced-apart L-shaped lifting members;

a pair of semi-circular convex members attached to the rear of the spaced-apart L-shaped lifting members;

a pair of horizontal bracing members attached to the rear of the spaced-apart L-shaped lifting members and between the semi-circular convex members;

and a pair of vertical bracing members extending between the pair of horizontal bracing members.

13. The lifting assembly of claim 12 wherein an opening is formed between the spaced-apart L-shaped lifting members, the convex members and the horizontal bracing members and is designed to fit around the tubular member of the support bracket.

14. The lifting assembly of claim 12 wherein:

the piering pole extends through the support bracket and lifting bracket.

15. The lifting assembly of claim 12 wherein:

the support bracket is installed on the piering pole for engaging the edge of the load.

16. The lifting assembly of claim 11 wherein:

one end of the jacking apparatus is attached to the lifting bracket and the other end of the jacking apparatus is attached to an upper end of the piering pole.

17. The lifting assembly of claim 11 wherein:

the jacking apparatus includes a support brace located above the lifting bracket.

18. The lifting assembly of claim 17 wherein:

the support brace includes a circular sleeve that encircles the piering pole, two support wings extending in opposite directions from the circular sleeve, and a pair of hydraulic rams oriented on the either side of and running parallel to the piering pole.

19. The lifting assembly of claim 18 wherein:

the hydraulic rams connect to respective wings of the lifting bracket and support wings of the support brace.

* * * * *